US010340131B2

(12) United States Patent
Allison

(10) Patent No.: US 10,340,131 B2
(45) Date of Patent: Jul. 2, 2019

(54) METHODS AND APPARATUSES RELATING TO CLEANING AND IMAGING AN ION SOURCE USING REFLECTED LIGHT

(71) Applicant: KRATOS ANALYTICAL LIMITED, Manchester, Greater Manchester (GB)

(72) Inventor: John Mark Allison, Carnforth Cumbria (GB)

(73) Assignee: KRATOS ANALYTICAL LIMITED, Manchester, Greater Manchester (GB)

( * ) Notice: Subject to any disclaimer, the term of this patent is extended or adjusted under 35 U.S.C. 154(b) by 0 days.

(21) Appl. No.: 15/516,056

(22) PCT Filed: Sep. 21, 2015

(86) PCT No.: PCT/GB2015/052716
§ 371 (c)(1),
(2) Date: Mar. 31, 2017

(87) PCT Pub. No.: WO2016/051134
PCT Pub. Date: Apr. 7, 2016

(65) Prior Publication Data

US 2017/0309464 A1 Oct. 26, 2017

(30) Foreign Application Priority Data

Oct. 1, 2014 (GB) ..... 1417356.1

(51) Int. Cl.
*B08B 7/00* (2006.01)
*H01J 49/16* (2006.01)

(52) U.S. Cl.
CPC ..... *H01J 49/164* (2013.01); *B08B 7/0042* (2013.01); *B08B 7/0057* (2013.01); *B08B 7/0035* (2013.01)

(58) Field of Classification Search
None
See application file for complete search history.

(56) References Cited

U.S. PATENT DOCUMENTS 5,101,415 A 3/1992 Kolb et al.
5,814,165 A 9/1998 Tatah et al.
(Continued)

FOREIGN PATENT DOCUMENTS

CN 103053006 A 4/2013
EP 0476857 A1 3/1992
(Continued)

OTHER PUBLICATIONS

Written Opinion of the International Searching Authority of PCT/GB2015/052716 dated Dec. 1, 2015.
(Continued)

*Primary Examiner* — James Choi
(74) *Attorney, Agent, or Firm* — Sughrue Mion, PLLC

(57) ABSTRACT

A method of cleaning an ion source. The method includes: at a first reflective surface of a mirror, reflecting light that has a wavelength in a first wavelength band onto a surface of the ion source so that contaminant material is desorbed from the surface of the ion source; at a second reflective surface of the mirror, reflecting light that has a wavelength in a second wavelength band and that comes from the surface of the ion source towards an imaging apparatus for producing an image of the surface of the ion source, wherein the light that has a wavelength in the second wavelength band passes through the first reflective surface of the mirror before being reflected at the second reflective surface of the mirror.

13 Claims, 5 Drawing Sheets

(56) References Cited

U.S. PATENT DOCUMENTS

| | | | | |
|---|---|---|---|---|
| 7,110,113 | B1 | 9/2006 | Janik et al. | |
| 2007/0114438 | A1 | 5/2007 | Holle et al. | |
| 2008/0151215 | A1* | 6/2008 | Soer | B82Y 10/00 355/75 |
| 2009/0200457 | A1 | 8/2009 | Holle et al. | |
| 2012/0154903 | A1 | 6/2012 | Miesak | |
| 2013/0118523 | A1* | 5/2013 | Allison | B08B 7/0042 134/1 |
| 2015/0219997 | A1* | 8/2015 | Kawabe | G02B 5/0833 355/67 |

FOREIGN PATENT DOCUMENTS

| | | | |
|---|---|---|---|
| GB | 2 398 923 | A | 9/2004 |
| GB | 2 486 628 | A | 6/2012 |

OTHER PUBLICATIONS

International Search Report of PCT/GB2015/052716 dated Dec. 1, 2015.

Communication dated Dec. 17, 2018, from Intellectual Property Office of Great Britain in counterpart application No. GB1417356.1.

* cited by examiner

METHODS AND APPARATUSES RELATING TO CLEANING AND IMAGING AN ION SOURCE USING REFLECTED LIGHT

CROSS REFERENCE TO RELATED APPLICATIONS

This application is a National Stage of International Application No. PCT/GB2015/052716 filed Sep. 21, 2015, claiming priority based on British Patent Application No. 1417356.1 filed Oct. 1, 2014, the contents of all of which are incorporated herein by reference in their entirety.

This invention relates to methods and apparatuses relating to cleaning an ion source.

Time of flight ("TOF") mass spectrometry is an analytical technique for measuring the mass/charge ratio of ions by accelerating ions and measuring their time of flight to an ion detector.

Matrix-assisted laser desorption/ionization, often referred to as "MALDI", is an ionisation technique in which, generally, a laser is used to fire light at a (usually crystalised) mixture of sample material and light absorbing matrix so as to ionise the sample material. The sample materials used with MALDI typically include molecules such as biomolecules (e.g. proteins), large organic molecules and/or polymers. The light absorbing matrix is generally used to protect such molecules from being damaged or destroyed by light from the laser. The resulting ions, which typically have masses of several thousand Daltons, are then accelerated to high kinetic energies, typically around 20 keV. Generally, an ion source configured to generate ions by MALDI is referred to as a "MALDI ion source". A MALDI ion source typically includes a laser for ionising sample material by firing light at a mixture of the sample material and light absorbing matrix.

Generally, when a MALDI ion source is in use, a laser of the MALDI ion source fires a pulse of (e.g. UV) light at a mixture of sample material and light absorbing matrix contained in a sample spot so as to eject a plume of ionised and non-ionised (i.e. neutral) sample material ("analyte") and light absorbing matrix from the sample spot. The ionised material contained in this plume (mostly ions of sample material and some ions of light absorbing matrix) will generally be guided/accelerated away by an electric field produced by one or more electrodes of the MALDI ion source so as to pass through apertures in the electrodes, e.g. for subsequent detection by an ion detector. However, the non-ionised material contained in this plume (mostly non-ionised light absorbing matrix and some non-ionised sample material) will generally continue to expand from the sample spot until it is deposited on surfaces in the vicinity of the ion source, e.g. surfaces of the electrodes of the MALDI ion source.

Over time, the non-ionised material builds up on the surfaces in the vicinity of the sample spot, particularly on the surfaces of the electrodes of the MALDI ion source, to form an insulating layer of contaminant material that may charge up over time and adversely affect the operation of the MALDI ion source. In particular, the insulating layer of contaminant material on the electrodes can distort the electric field produced by the electrodes such that the sensitivity or resolution of a mass spectrometer using the MALDI ion source is degraded. At this point the electrodes of the MALDI ion source will generally require cleaning.

For many years the principal method of cleaning the electrodes of a MALDI ion source was to vent and open an evacuated housing containing the electrodes to allow the electrodes to be cleaned in situ or removed completely for thorough cleaning. In both cases, in addition to the cleaning time, several hours were generally required to restore a vacuum to the housing of the MALDI ion source (once closed) and to perform high voltage conditioning, instrument tuning and mass calibration procedures that are generally necessary for the MALDI ion source to be used in mass spectrometry.

In many applications (e.g. biochemistry) there is a growing requirement for higher throughput mass spectrometers, which can now be realised by the introduction of MALDI ion sources capable of running at repetition rates of 1 kHz or over. This has increased the rate of contamination build up on the electrodes of MALDI ion sources, and the frequency with which they must be cleaned, to such an extent that it is generally no longer practical to vent the MALDI ion source every time its electrodes require cleaning.

These considerations make it desirable to find an effective method to clean the electrodes of MALDI ion sources without requiring an evacuated housing of the MALDI ion source to be vented.

Various methods have been considered to clean the electrodes of MALDI ion sources without the need to vent an evacuated housing of the MALDI ion source. Some such methods are described, for example, in the background section of GB2486628.

In the main section of GB2486628, there is proposed a method of cleaning at least one surface of an ion source by directing UV light on to the surface such that contaminant material is desorbed from the surface. In this way, the at least one surface of the ion source can be cleaned in a simple manner, without having to significantly heat the surface and without having to vent an evacuated housing of the ion source.

The present inventors have found that whilst the method proposed in GB2486628 works well, the effectiveness of the cleaning method proposed in GB2486628 can begin to deteriorate after a relatively small number of cleaning cycles. This problem is described in more detail below (with reference to FIG. 2 and FIG. 3).

The inventors therefore believe it would be desirable to find a way to clean a surface of an ion source in a manner that is more resilient to repeated cleaning cycles.

The present invention has been devised in light of the above considerations.

A first aspect of the invention may provide:

A method of cleaning an ion source, the method including:

at a first reflective surface of a mirror, reflecting light that has a wavelength in a first wavelength band onto a surface of the ion source so that contaminant material is desorbed from the surface of the ion source;

at a second reflective surface of the mirror, reflecting light that has a wavelength in a second wavelength band and that comes from the surface of the ion source towards an imaging apparatus for producing an image of the surface of the ion source, wherein the light that has a wavelength in the second wavelength band passes through the first reflective surface of the mirror before being reflected at the second reflective surface of the mirror.

In this way, the first reflective surface can be optimised to reflect the light that has a wavelength in the first wavelength band (e.g. for effective cleaning of the surface of the ion source) and the second reflective surface can be optimised to reflect the light that has a wavelength in the second wavelength band (e.g. for forming an image of the surface of the ion source). Thus, for example, the first reflective surface can be optimised to suppress deterioration of the mirror caused by the light that has a wavelength in the first wavelength band, and the second reflective surface can be optimised to allow a focussed image of the surface of the ion source to be produced by the imaging apparatus using the light that has a wavelength in the second wavelength band.

Preferably, the ion source includes a laser for ionising sample material by firing light at the sample material. Preferably, the laser is for ionising sample material by firing pulses of light at the sample material. The light produced by the laser is preferably UV light.

The laser for ionising sample material may include a focus adjustment mechanism for adjusting a focus of light produced by the laser. Alternatively, the laser for ionising sample material may have a fixed (non-adjustable) focus.

Preferably, the light that has a wavelength in the first wavelength band is produced by the laser for ionising sample material. This is highly preferred since, as discussed e.g. in GB2486628, the laser for ionising sample material will, in general, already produce light capable of desorbing sample material from a surface of the ion source, thereby making it unnecessary to incorporate a separate light source for producing the light that has a wavelength in the first wavelength band.

Nonetheless, in other embodiments, the light that has a wavelength in the first wavelength band may be produced by a separate light source (e.g. a laser) that is, for example, additional to a laser for ionising sample material.

Preferably, the light that has a wavelength in the first wavelength band is ultraviolet ("UV") light. Ultraviolet light may be defined as light that has a wavelength that is in the range 10 nm to 400 nm. The term "light that has a wavelength in a first wavelength band" may therefore be replaced with the term "UV light that has a wavelength in the range 10 nm to 400 nm" herein.

As discussed in GB248628, UV light has been found to be particularly useful in desorbing contaminant material from a surface of an ion source without having to significantly heat the surface of the ion source.

Preferably, the light that has a wavelength in the first wavelength band has a wavelength in the range 300 nm to 400 nm. This is the most useful wavelength range for MALDI ion sources, since this is the wavelength range over which a typical MALDI matrix actually absorbs light.

Preferably, the first reflective surface of the mirror has a reflectivity of 90% or more, more preferably 99% or more, more preferably 99.9% or more to the light that has a wavelength in the first wavelength band. This helps to reduce the amount of energy absorbed in the mirror from such light, and therefore helps to suppress deterioration of the mirror caused by absorption of such light.

The first reflective surface may have a reflectivity to light that has a wavelength in the second wavelength band of 10% or less, or even 5% or less.

The imaging apparatus for producing an image of the surface of the ion source may be a camera, which may be configured to produce an image of the surface of the ion source using visible light.

It is common for an ion source to include an imaging apparatus (e.g. a camera) for producing an image of a sample. Typically, such an imaging apparatus will be configured to produce an image of a sample using visible light. Typically, such an imaging apparatus will be accompanied by a light source for illuminating the sample with visible light (e.g. a white LED). Typically, such an imaging apparatus will be configured to produce a focussed image of a sample lying in a sample plane.

Preferably, the imaging apparatus for producing an image of a sample is also used as the imaging apparatus for producing an image of the surface of the ion source. In this way, just one imaging apparatus can be used for producing both an image of a sample (e.g. when the sample material lies in the beam axis) and an image of the surface of the ion source (e.g. when the mirror lies in the beam axis).

Nonetheless, in other embodiments, the imaging apparatus for producing an image of the surface of the ion source may be separate from (i.e. additional to) an imaging apparatus for producing an image of the sample. This could be appropriate e.g. if the light that has a wavelength in the first wavelength band is produced by a light source (e.g. a laser) that is additional to a laser for ionising sample material.

The ion source may include a light source for illuminating the surface of the ion source with light having a wavelength in the second wavelength band, e.g. so this light can be reflected by the surface of the ion source thereby providing the light that has a wavelength in the second wavelength band and that comes from the surface of the ion source.

Preferably a light source for illuminating the sample with visible light (e.g. a white LED) is also used as the light source for illuminating the surface of the ion source with light having a wavelength in the second wavelength band. In this way, just one light source can be used for illuminating both the sample and the surface of the ion source with light in the second wavelength band. However, separate light sources may be used for these purposes.

The imaging apparatus for producing an image of a sample may include a focus adjustment mechanism for adjusting the plane from which the imaging apparatus produces a focussed image. Alternatively, the imaging apparatus for producing an image of a sample may have a fixed focus, i.e. so that the plane from which the imaging apparatus produces a focussed image is fixed.

A focus adjustment mechanism (for adjusting a focus of light produced by the laser or for adjusting the plane from which the imaging apparatus produces a focussed image) may include, for example, a mechanism for translating optics along an appropriate optical axis or a mechanism for inserting/removing elements from an appropriate optical axis). Of these alternatives, a focus adjustment mechanism that includes a mechanism for translating optics along an appropriate optical axis is preferred.

Preferably, the second reflective surface has a reflectivity to the light that has a wavelength in the second wavelength band of 50% or more, more preferably 80% or more.

Preferably, the light that has a wavelength in the second wavelength band is visible light. Visible light may be defined as light that has a wavelength that is in the range 390 nm to 700 nm. The term "light that has a wavelength in a second wavelength band" may therefore be replaced with the term "visible light that has a wavelength that is in the range 390 nm to 700 nm" herein.

For the avoidance of any doubt, the second reflective surface may reflect light that has a plurality of wavelengths in the second wavelength band, e.g. visible light having a plurality of wavelengths. Thus, the method may include, at a second reflective surface of the mirror, reflecting light that has a plurality of wavelengths in a second wavelength band and that comes from the surface of the ion source towards an imaging apparatus for producing an image of the surface of the ion source, wherein the light that has a plurality of wavelengths in the second wavelength band passes through the first reflective surface of the mirror before being reflected at the second reflective surface of the mirror.

Preferably, the ion source includes one or more electrodes, e.g. a first electrode and a second electrode. The or each electrode of the ion source may be annular (ring-shaped) and may define an aperture.

The surface of the ion source is preferably a surface of an electrode of the ion source (e.g. the first or second electrode described above).

The one or more electrodes of the ion source may be configured to accelerate and/or guide ionised sample material along an ion axis.

The laser for ionising sample material (if present) is preferably configured to produce light that passes along a beam axis.

The imaging apparatus for producing an image of a sample (if present) is preferably configured to produce an image using light that passes along an optical axis.

The ion axis may pass through one or more apertures defined by the one or more electrodes of the ion source. In this case, the laser for ionising sample material (if present) is preferably configured to produce light that passes along a beam axis that extends through the one or more apertures defined by the one or more electrodes of the ion source. Similarly, the imaging apparatus for producing an image of a sample (if present) is preferably configured to produce an image using light that passes along an optical axis which extends through the one or more apertures defined by the one or more electrodes of the ion source.

Preferably, the beam axis (if the laser for ionising sample material is present) crosses the ion axis at a sample plate (if a sample plate is lying in the ion axis). Preferably, the beam axis (if the laser for ionising sample material is present) is offset from the ion axis, e.g. by a small angle (preferably 10° or less, more preferably 5° or less), so as to prevent any optical/beam steering component (e.g. a mirror) lying in the beam axis from interfering with (e.g. by blocking) ionised sample material travelling along the ion axis. Preferably the offset angle is chosen such that there is at least a 3 mm gap between the beam axis and the ion axis at an optical/beam steering component (e.g. a mirror) lying in the beam axis.

Preferably, the optical axis (if the laser for ionising sample material is present) crosses the ion axis at a sample plate (if a sample plate is lying in the ion axis).

Preferably, the optical axis (if the imaging apparatus for producing an image of a sample is present) is offset from the ion axis, e.g. by a small angle (preferably 10° or less, more preferably 5° or less), so as to prevent any optical/beam steering component (e.g. mirror) lying in the optical axis from interfering with (e.g. by blocking) ionised sample material travelling along the ion axis. Preferably the offset angle is chosen such that there is at least a 3 mm gap between the optical axis and the ion axis at an optical/beam steering component (e.g. a mirror) lying in the beam axis.

Preferably, the beam axis (if the laser for ionising sample material is present) and the optical axis (if the imaging apparatus for producing an image of a sample is present) are offset from each other, e.g. by a small angle (preferably 10° or less, more preferably 5° or less) and/or a small distance, so as to allow the light produced by the laser to be separated from the light received by the imaging apparatus, e.g. using one or more optical/beam steering components (e.g. mirrors).

Preferably, the method includes, at the imaging apparatus, producing an image of the surface of the ion source using the light that has a wavelength in the second wavelength band.

Preferably, the light that has a wavelength in the first wavelength band is reflected at the first reflective surface of the mirror (onto a surface of the ion source) at the same time as the light that has a wavelength in the second wavelength band is reflected at the second reflective surface of the mirror (towards the imaging apparatus). In this way, an image of the surface of the ion source can be produced (at the imaging apparatus) at the same time as contaminant material is desorbed from that same surface of the ion source. The image produced at the imaging device (which is preferably a moving image, preferably produced in "real time") may be useful helping an observer to move the mirror to scan the light that has a wavelength in the first wavelength band across the surface, as described below.

Preferably, the method includes moving the mirror to scan the light that has a wavelength in the first wavelength band across the surface (optionally multiple surfaces that include the surface) of the ion source.

Preferably, the first and second reflective surfaces of the mirror are concave with respect to the laser for ionising sample material. In this way, light that has a wavelength in the first wavelength band can be scanned across the surface (or multiple surfaces) of the ion source simply by translating the mirror in a plane.

Preferably, the first and second reflective surfaces have a spherical curvature, since spherical reflective surfaces are generally cheaper to manufacture than other curved surfaces. However, other curvatures (e.g. parabolic) are possible.

Preferably, the first reflective surface is on top of the second reflective surface of the mirror.

Preferably, the first reflective surface is configured (e.g. by having an appropriate curvature) to focus the light that has a wavelength in the first wavelength band such that the light has a predetermined energy density at the surface of the ion source.

The predetermined energy density at the surface of the ion source per pulse of light that has a wavelength in the first wavelength band may be 1 $\mu J/mm^2$ or more, 10 $\mu J/mm^2$ or more, 100 $\mu J/mm^2$ or more, 200 $\mu J/mm^2$ or more, 400 $\mu J/mm^2$ or more or 500 $\mu J/mm^2$ or more; and/or 2000 $\mu J/mm^2$ or less, 1000 $\mu J/mm^2$ or less, 800 $\mu J/mm^2$ or less or 600 $\mu J/mm^2$ or less. These values may be combined in any combination. For example, each pulse of UV light may have an energy density at a surface of the at least one surface of the ion source that is in the range 400 $\mu J/mm^2$ to 800 $\mu J/mm^2$. Such energy densities (per pulse) have been found to effectively desorb contaminant material.

In some embodiments, the first and second reflective surfaces have the same curvature. As discussed in more detail below, this may be appropriate e.g. if the laser for ionising sample material includes a focus adjustment mechanism and/or the imaging apparatus for producing an image of the sample includes a focus adjustment mechanism.

In some embodiments, the first and second reflective surfaces have different curvatures. As discussed in more detail below, this may be appropriate e.g. if the laser for ionising sample material is fixed focus and the imaging apparatus for producing an image of the sample is fixed focus.

If the laser for ionising sample material is fixed focus and the imaging apparatus for producing an image of the sample is fixed focus, the first reflective surface is preferably configured (e.g. by having an appropriate curvature) to focus light produced by the laser for ionising sample to a predetermined energy density at the surface of the ion source and the second reflective surface is preferably configured (e.g.

by having an appropriate curvature) to focus light from the surface of the ion source such that a focussed image (of the surface of the ion source) can be produced by the imaging apparatus for producing an image of the sample.

If the laser for ionising sample material includes a focus adjustment mechanism and/or the imaging apparatus for producing an image of the sample includes a focus adjustment mechanism, the first reflective surface may nonetheless still be configured (e.g. by having an appropriate curvature) to focus light produced by the laser for ionising sample to a predetermined energy density at the surface of the ion source and the second reflective surface may be configured (e.g. by having an appropriate curvature) to focus light from the surface of the ion source such that a focussed image can be produced by the imaging apparatus for producing an image of the sample. However, this is not as important as it is in the fixed focus scenario described above, since the necessary focus adjustments may instead be provided by the focus adjustment mechanism(s).

Preferably, the mirror is mounted on a sample holder for holding sample material to be ionised by the ion source. In this way, both the mirror, and sample material held by the sample holder, can be moved into (and out from) light produced by the laser for ionising sample material simply by moving the sample holder.

Preferably, the mirror is mounted on the sample holder such that the first and second reflective surfaces are at a different distance from a laser for ionising sample material compared with a sample held by the sample holder. This may be helpful in allowing the first reflective surface to focus light from the laser to have a predetermined energy density at the surface of the ion source.

The sample holder may include a sample plate for holding sample material in one or more "sample spots". The sample holder may include a sample plate carrier for carrying a sample plate.

The ion source may be a MALDI ion source. For a MALDI ion source, the sample material may include biomolecules (e.g. proteins), organic molecules and/or polymers. The sample material may be included in a (preferably crystalised) mixture of sample material and light absorbing matrix. Cleaning electrodes has been found to be a particular concern for MALDI ion sources. However, the surfaces (e.g. electrodes) of other types of ion source may also need cleaning.

The contaminant material may, for example, include or be non-ionised sample material and/or light absorbing matrix such as DCTB (T-2-(3-(4-t-Butyl-phenyl)-2-methyl-2-propenylidene)malononitrile), DHB (2,5-dihydroxybenzoic acid), SA (sinapinic acid), DTL (1,8,9-anthrecenetriol (dithranol)) or CHCA (α-Cyano-4-hydroxycinnamic acid). For example, the non-ionised sample material and/or the non-ionised light absorbing matrix could originate from a mixture of sample material and light absorbing matrix previously used in the ion source.

The ion source may be included in a mass spectrometer, preferably a TOF mass spectrometer, more preferably a MALDI TOF mass spectrometer. The mass spectrometer may include an ion detector for detecting ions, e.g. a pulse of ions, generated by the ion source.

The ion source may be for producing ionised sample material for use in a mass spectrometer.

A second aspect of the invention may provide an ion source for producing ionised sample material, the ion source including a mirror including a first reflective surface and a second reflective surface.

The ion source may be configured to be cleaned by a method as set out in the first aspect of the invention.

The ion source may include any optional feature described above in connection with the first aspect of the invention.

A third aspect of the invention may provide a mirror for use in an ion source, the mirror including a first reflective surface and a second reflective surface.

The mirror may be configured to be used in cleaning an ion source by a method as set out in the first aspect of the invention.

The ion source may include any optional feature described above in connection with the first and/or second aspects of the invention.

The invention also includes any combination of the aspects and preferred features described except where such a combination is clearly impermissible or expressly avoided.

The invention may also include any optional feature(s) described in GB2486628, except where such inclusion is clearly impermissible or expressly avoided.

In the context of this application, "light" is preferably taken to mean electromagnetic radiation. "Desorption" of a substance from a surface is preferably mean the releasing/removal of that substance from the surface.

Examples of the inventors proposals are discussed below, with reference to the accompanying drawings in which:

FIG. 1 at (a) shows a MALDI ion source 100 that is not an embodiment of the present invention, but is included for the purposes of better understanding the present invention.

FIG. 1 at (b) schematically illustrates a preferred relationship between the beam axis 130 and the ion axis 122 of FIG. 1 at (a).

1. ANALYSIS OF EXISTING CLEANING METHODS

Figure 1:
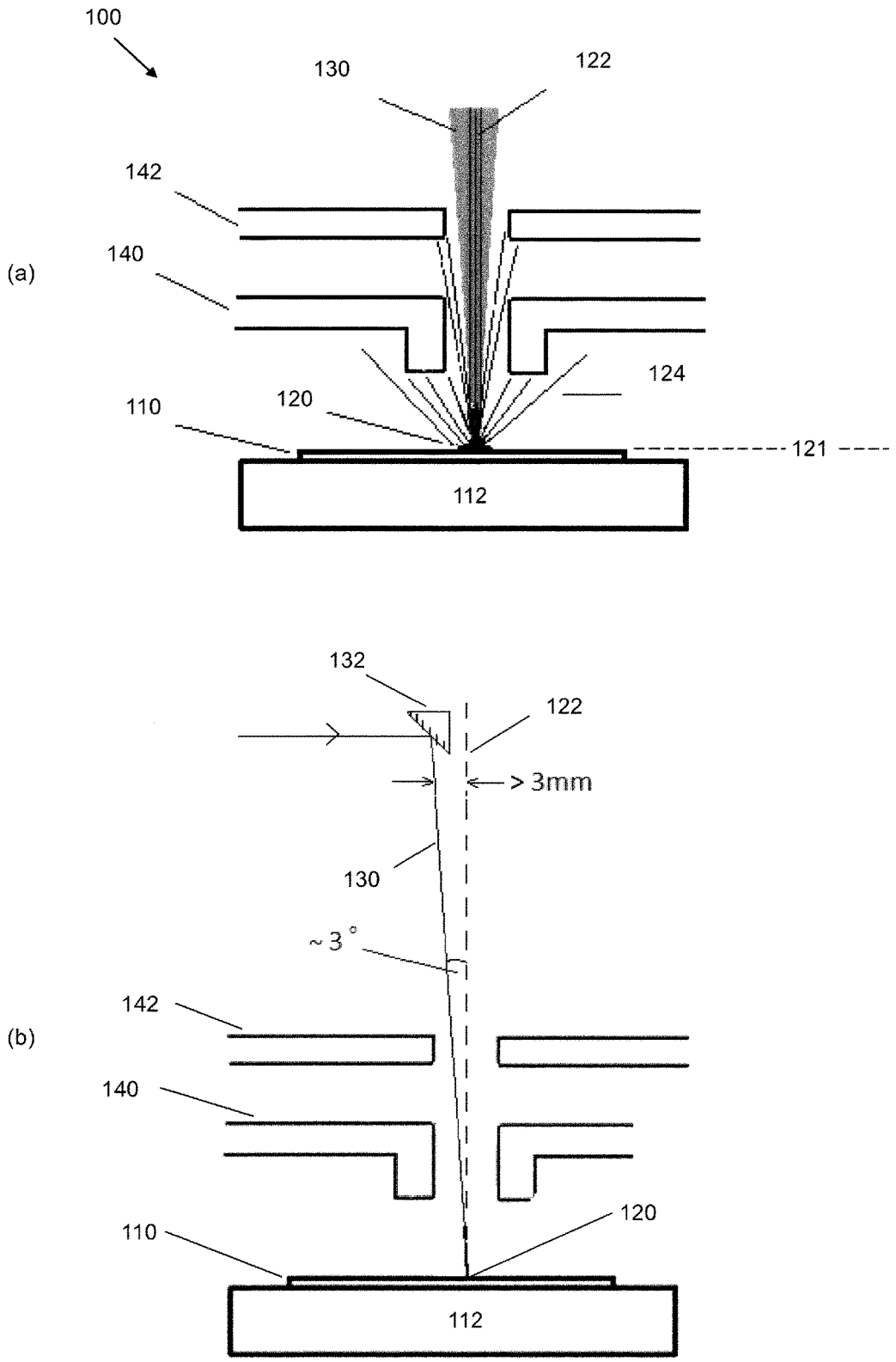

FIG. 1 at (a) shows a MALDI ion source 100 that is not an embodiment of the present invention, but is included for the purposes of better understanding the present invention.

The MALDI ion source 100 shown in FIG. 1 at (a) has a sample holder for holding sample material to be ionised by the MALDI ion source 100, The sample holder includes a sample plate 110, which is removable from the MALDI ion source 100, for holding a crystalised mixture of sample material and light absorbing matrix in a sample spot 120, and a sample plate carrier 112, which is not removable from the MALDI ion source 100, for carrying the sample plate 110.

The MALDI ion source 100 also has a laser (not shown) for ionising sample material by firing pulses of light, in this example pulses of UV light, in the form of a pulsed laser beam that passes along a beam axis 130, at the sample material. As shown in FIG. 1 at (a), the UV light produced by the laser is focused to converge at a focal point whose position coincides with the sample spot 120.

The MALDI ion source 100 also has a first electrode 140 and a second electrode 142 for producing an electric field to accelerate ions generated by the laser to a predetermined kinetic energy, e.g. 20 keV. The first and second electrodes 140, 142 are each shaped to define an aperture through which ions generated by the laser can pass through as they are guided/accelerated by the first and second electrodes 140, 142 so as to pass along an ion axis 122.

The MALDI ion source 100 also includes a housing (not shown) for containing the electrodes 140, 142 and the sample holder. The housing is preferably evacuated prior to the MALDI ion source 100 being used.

In use, the laser fires a pulse of light at the mixture of sample material and light absorbing matrix contained in the sample spot 120 so as to eject a plume of ionised and non-ionised (i.e. neutral) sample material ("analyte") and light absorbing matrix. The ionised material contained in this plume (mostly ions of sample material and some ions of light absorbing matrix) will generally be guided/accelerated away by an electric field produced by the first and second electrodes 140, 142 so as to pass along the ion axis 122 which passes through apertures defined by the first and second electrodes 140, 142, e.g. for subsequent detection by an ion detector. However, the non-ionised material 124 contained in this plume (mostly non-ionised light absorbing matrix and some non-ionised sample material) will generally continue to expand from the sample spot 120 until it is deposited on surfaces in the vicinity of the sample spot, e.g. surfaces of the first and second electrodes 140, 142. In general, much of the non-ionised material 124 will be deposited on a surface of the first electrode 140, but some non-ionised material 124 may also pass through the aperture in the first electrode 140 to be deposited on a surface of second electrode 142.

Over time, the non-ionised material builds up on the surfaces in the vicinity of the sample spot, particularly on the surfaces of the first and second electrodes 140, 142, to form an insulating layer of contaminant material that may charge up over time and adversely affect the operation of the MALDI ion source 100. In particular, the insulating layer of contaminant material on the first and second electrodes 140, 142 can distort the electric field produced by the first and second electrodes 140, 142 such that the sensitivity or resolution of a mass spectrometer using the MALDI ion source 100 is degraded. At this point the first and second electrodes 140, 142 of the MALDI ion source will generally require cleaning.

In this way, UV light from a UV laser is focused onto a sample plate 110 to desorb and ionise a sample to be analysed in a mass spectrometer.

FIG. 1 at (b) schematically illustrates a preferred relationship between the beam axis 130 15 and the ion axis 122 of FIG. 1(*a*).

Although the beam axis 130 and the ion axis 122 are depicted in FIG. 1 at (a) as being parallel, it is preferred, as shown in FIG. 1 at (b), that the beam axis 130 is offset from the ion axis 122 by a small angle (in this example 3°), so as to prevent any optical/beam steering component (in this example a mirror 132) lying in the beam axis 130 from interfering with (e.g. by blocking) ionised sample material travelling along the ion axis 122. Preferably the offset angle is chosen such that there is at least a 3 mm gap between the beam axis 130 and the ion axis 122 at the optical/beam steering component. As shown in FIG. 1 at (b), the beam axis 130 preferably crosses the ion axis 122 at the sample spot 120, where these axes converge.

The MALDI ion source preferably includes a light source of visible light (e.g. a white LED) for illuminating a sample, and an imaging apparatus (e.g. a camera) for producing an image of the sample using visible light that passes along an optical axis which extends through the apertures defined by the first and second electrodes 140, 142. The imaging apparatus is preferably configured to produce a focussed image of a sample lying in a sample plane 121 (which may the plane of the sample plate 110).

It is preferred that the optical axis is preferably is offset from the ion axis 122 by a small angle (e.g. 3°), so as to prevent any optical/beam steering component (e.g. a mirror) lying in the beam axis 130 from interfering with (e.g. by blocking) ionised sample material travelling along the ion axis 122. This can be achieved in a similar manner to that shown for the beam axis 130 in FIG. 1 at (b), though of course the beam axis 130 and the optical axis should be offset from each other, so as to allow the light produced by the laser to be separated from the light received by the imaging apparatus.

Figure 2:
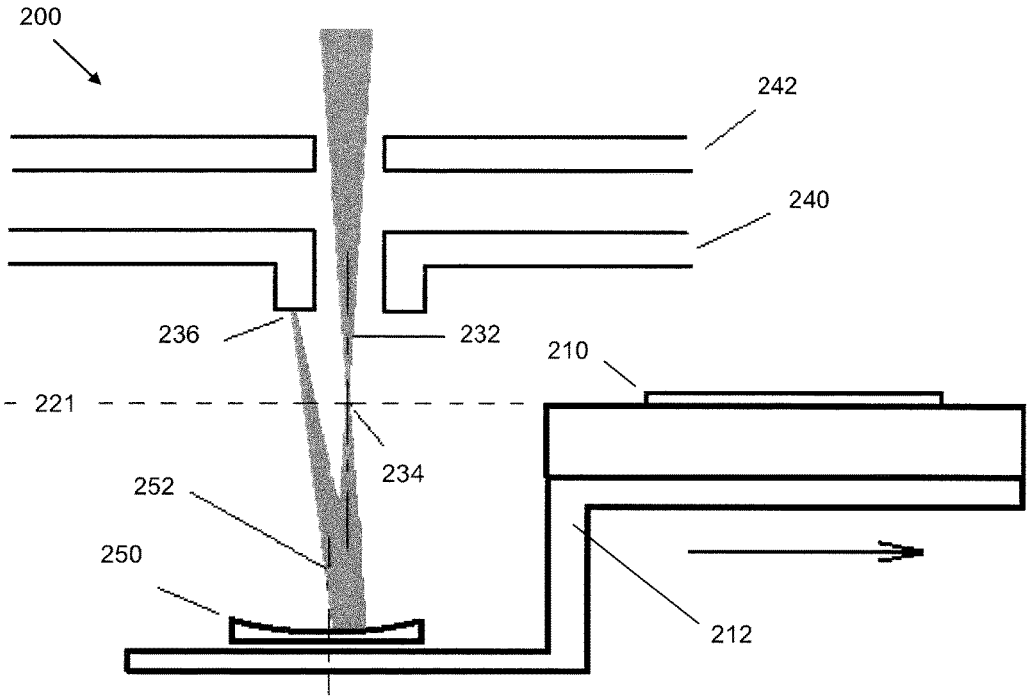
FIG. 2 shows another MALDI ion source 200 that is not an embodiment of the present invention, but is included for the purposes of better understanding the present invention.

FIG. 2 shows another MALDI ion source 200 that is not an embodiment of the present invention, but is included for the purposes of better understanding the present invention.

The MALDI ion source 200 implements the teaching of GB2486628.

Many features of the MALDI ion source 200 shown in FIG. 2 are the same as those of the MALDI ion source 100 shown in FIG. 1 at (a).

Where appropriate throughout this specification, corresponding features have been given corresponding reference numerals and need not be discussed in further detail.

As can be seen from FIG. 2, the sample holder includes a differently shaped sample plate carrier 212, having both a first level on which the sample plate 210 is mounted and a second level on which a concave reflective surface is provided by a UV mirror 250. Thus, the mirror is mounted on the sample plate carrier 212 such that the reflective surface is at a different distance from the laser for ionising sample material. In this example, the concave reflective surface of the mirror 250 has a generally spherical curvature and a central axis 252.

The sample plate carrier is configured to be moved in a plane 221 substantially perpendicular (e.g. within 10° of perpendicular) to a beam axis 232 of the laser (i.e. axis of laser beam) for ionising sample material so as to allow both the sample plate 210, and the mirror 250, to be moved into and out of the beam axis 232.

In use to generate ions, a sample spot 220 on the sample plate 210 is moved into the beam axis 232 of the laser such that UV light from the laser is focussed to converge at a first focal point 234 whose position coincides with the sample spot 220.

In use to clean one of the electrodes 240, 242, the mirror 250 is moved into the beam axis 232 of the laser such that UV light from the laser is directed on to a surface of one of the electrodes 240, 242 via the mirror 250 which reflects the UV light from the laser. Advantageously, the UV light is able to couple energy directly into contaminant material on the surface of the electrode so as to cause the contaminant material to desorb from the surface of the electrode without having to significantly heat the electrode, and without having to vent the evacuated housing of the MALDI ion source 200.

Once located in the beam axis 232 of the laser, the mirror 250 is preferably translated, e.g. continuously, in a plane substantially perpendicular (e.g. within 10° of perpendicular) to the beam axis 232 of the laser, such that the UV light from the laser is scanned across a surface of either or both of the electrodes 240, 242, preferably in two dimensions.

As shown in FIG. 2, the UV light from the laser is firstly focussed by one or more lenses associated with the laser (not shown) to converge at a first focal point 234 and is subsequently refocused by the mirror 250 to converge at a second focal point 236 ("refocussed laser spot"). As shown in FIG. 2, the position of the second focal point 236 is at a surface of the first electrode 240. However, the position of the second focal point 236 can be chosen to be other than at a surface of an electrode, e.g. so as to achieve a predetermined energy density at a surface of the electrode.

Thus, cleaning of the ion source 200 is preferably achieved by using UV light produced by the UV laser otherwise used for ionising sample material to irradiate the electrodes of the ion source and desorb contaminant material (ionisation debris) deposited on their surfaces.

As discussed above, the concave reflective surface of the mirror 250 sits below the plane of the sample plate 210 and is accessed by removing or translating the sample plate carrier 212 away from the laser beam axis (see FIG. 2). Translating the mirror 250 in the plane substantially perpendicular (e.g. within 10° of perpendicular) to the laser beam scans the refocused laser beam across the electrode surfaces to be cleaned.

Thus, a single surface concave mirror 250 is used to reflect and refocus the UV laser beam onto an electrode of the ion source to desorb contaminant material.

GB2486628 also taught that the same surface of the mirror 250 could be used to visually assess the amount of contaminant material present on the electrode.

The present inventors note that in practice, visual assessment of contaminant material present on the electrode using the surface of the mirror 250 can be achieved using an imaging apparatus and a light source already present in the ion source for the purposes of providing an image of a sample.

As discussed above with reference to FIG. 1, a MALDI ion source may include a light source of visible light (e.g. a white LED) for illuminating a sample, and an imaging apparatus (e.g. a camera) for producing an image of the sample. The light source and imaging apparatus are also present in the ion source 200 (as well as the other ion sources discussed below).

The inventors have observed that the light source and imaging apparatus for producing an image of the sample can also be used to provide an image of the electrode being cleaned, e.g. so as to allow contaminant material on the electrode being cleaned to be visualised as it is being cleaned.

In more detail, the light source (although typically set up to provide illumination of the sample) has been found to be capable of provide adequate illumination of the electrode, thereby allowing the mirror 250 to reflect visible light from the electrode towards the imaging apparatus so that the imaging apparatus can provide an image of the surface of the electrode whilst it is being cleaned.

The present inventors have conducted further experimentation based on the teaching of GB2486628, which will now be described.

The mirror 250 initially selected by the present inventors to implement the method of GB2486628 was chosen to be a (readily available) off the shelf catalogue item to minimise cost, since this component was expected to have a finite lifetime and require changing periodically. It was already thought by the present inventors that the contaminant material desorbed from electrode surfaces during the cleaning process had to go somewhere and it was anticipated that some of that material would be deposited on the mirror surface and eventually adversely affect its performance resulting in the mirror needing to be cleaned or replaced.

The present inventors note that many coatings are available for mirrors and the appropriate coating for a given application depends on a number of factors, such as the wavelength bands of interest (e.g. IR, visible, UV), the reflectivity required, the power density of the incident light and even the environmental conditions. For the method of GB2486628 it was thought necessary to reflect sufficient UV laser light for the cleaning process to work efficiently, whilst preferably reflecting enough visible light (from the electrode surface) to enable the source electrodes to be imaged.

Figure 3:
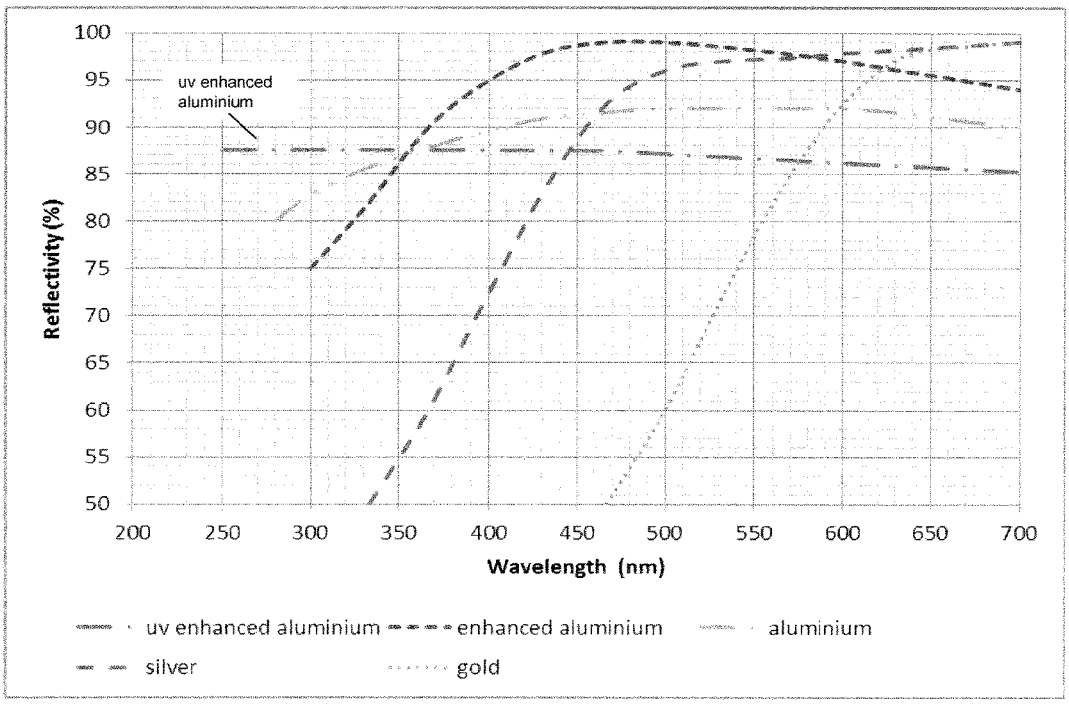
FIG. 3 shows typical reflectivity values for metal coated optics.

Metal mirror coating are widely used and performance curves for the commonly used metals aluminium, silver and gold are shown in FIG. 3, which shows typical reflectivity values for metal coated optics.

As shown by FIG. 3, the performance of an aluminium can be improved by coating a multi-layer film of dielectrics on top of the aluminium to enhance the reflectance in the visible or ultraviolet regions (this is the "enhanced aluminium" referred to in FIG. 3).

So, to implement the method of GB2486628, the UV enhanced aluminium coating was chosen for the mirror 250 so as to achieve maximum reflectivity at the laser wavelength range of interest, since typical UV lasers used for ionising sample material in MALDI ion sources typically produce UV light having a single wavelength falling in the range 337 nm to 355 nm. In more detail, the most commonly used lasers are Nitrogen lasers which produce UV light that has a wavelength of 337 nm and Nd:YAG lasers which produce UV light that has a wavelength of 355 nm, though other types of laser are available. Nitrogen lasers tend to have a poor repetition rate, so Nd:YAG lasers are more common in modern machines.

Note that by choosing the UV enhanced aluminium coating for the mirror 250, the reflectivity at the preferred laser wavelength (355 nm) is relatively high at over 87% and the reflectivity in the visible region (390 nm to 700 nm) is still sufficient (>85%) to image the source.

An initial evaluation of the ion source cleaning method of GB2486628 using this choice of coating material for the mirror 250 found the method to be successful with two electrode surfaces being effectively cleaned in approximately 15 minutes.

However, the present inventors found that effectiveness of the cleaning process began to deteriorate after around only 10 cleaning cycles. Inspection of the mirror 250 showed a visible degradation of the surface of the mirror 250 over the area scanned by the laser beam, which was also found to have a significantly reduced reflectivity.

As discussed above, the present inventors had anticipated that the mirror 250 would need to be cleaned or replaced at intervals, but it was hoped this would coincide with an annual maintenance procedure. The frequency with which ion sources require cleaning varies greatly and depends on the ion source configuration (e.g. inner diameter of electrode apertures, electrode spacing), the type of sample being analysed and of course the frequency of use. Whilst it is not possible to be sure of the number of cleaning operations required over a year, the present inventors have observed that this number is likely to be somewhat greater than 10 and in practice it is difficult to prevent a user cleaning the source significantly more often than really required.

The availability of inexpensive off the shelf mirrors potentially allows multiple mirrors to be fitted as a solution to this problem, but doing this increased the mechanical and control complexity of the system, as well as potentially increasing the size of the apparatus.

2. NEW CLEANING METHODOLOGIES

In general, the following discussion describes examples of the present inventors' proposals that relate to methods and apparatuses relating to cleaning at least one surface of an ion source.

These examples are based on an elegant solution the mirror degradation problem noted above (more elegant than using separate mirrors), which was achieved through the incorporation of a mirror that not only serves to increase the durability of the method, but also increased the flexibility of both the cleaning and imaging aspects compared with the method of GB2486628.

In some embodiments, off the shelf optics are utilised to achieve a low cost and effective process to clean source electrodes. In other embodiments, a custom mirror is used to improve the durability and flexibility of implementation. The cost of using a custom mirror slight higher compared with using an off the shelf mirror (e.g. £130 for the custom mirror compared with £50 for the off the shelf component, at 2014 prices), but the custom mirror is still far less expensive to implement than other cleaning schemes, e.g. as described in the background section of GB2486628.

Two implementations of the new cleaning methodology devised by the present inventors are set out here. Section 2.1, below, describes a first cleaning method that uses a two surface mirror with equal curvatures and Section 2.2, also below, describes a second cleaning method where the two surface curvatures are not equal and are instead optimised for ion source geometry.

2.1 First Cleaning Method: a Two Surface Mirror Including a Dielectric Coated First Surface and an Aluminium Coated Second Surface (Surfaces Having Equal Curvatures)

The UV enhanced aluminium mirror coating described previously had a reflectivity of around 87% in the UV. Whilst this reflectivity was found to be adequate for the cleaning process, it leaves a significant portion of energy (~13%) that is neither reflected nor scattered by the mirror. Without wishing to be bound by theory, the present inventors believe this energy is most likely absorbed by the coating and thus contributed to the degradation of the mirror surface. Thus, the present inventors considered it preferable to use a more robust coating on the mirror with a reflectivity much closer to 100% at the UV laser wavelength.

Figure 4:
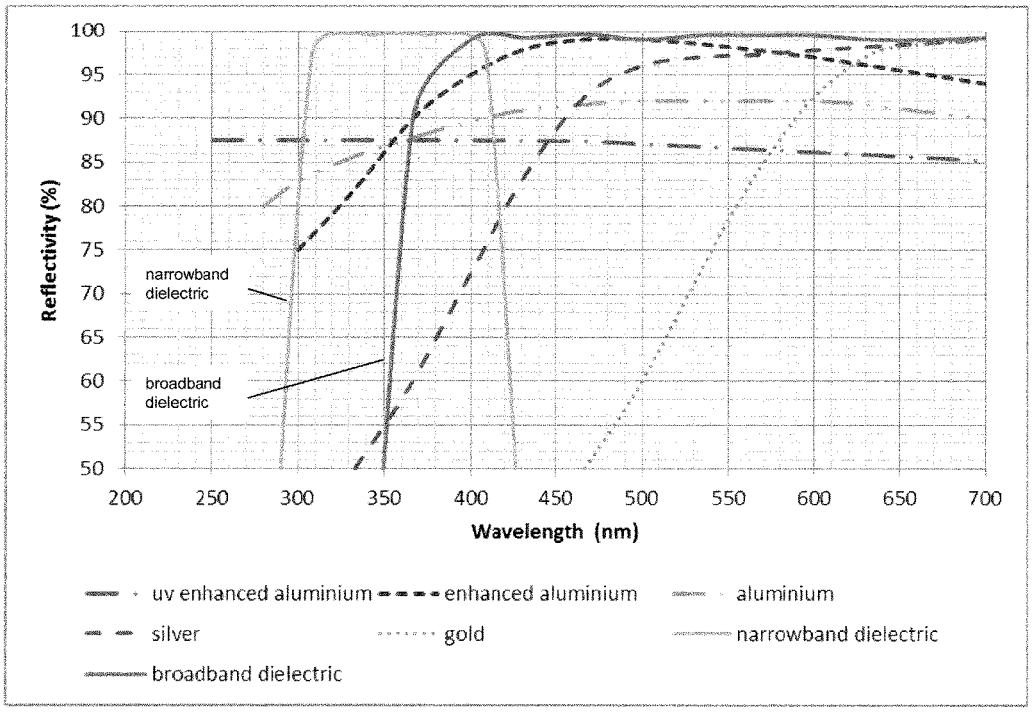
FIG. 4 shows typical reflectivity values for metal coated mirror, broadband dielectric coated mirror and dielectric coating mirror optimised for wavelength of 355 nm.

FIG. 4 shows typical reflectivity values for metal coated mirror, broadband dielectric coated mirror and dielectric coating mirror optimised for wavelength of 355 nm, which is the wavelength of light produced by the laser for ionising sample material in the ion source designed by the present inventors (note that dielectric coatings are made from proprietary prescriptions and will vary between manufactures).

A widely used robust and inexpensive mirror coating with a high reflectivity is a dielectric coating, which is composed of multiple thin layers of dielectric material, deposited on the mirror substrate. The type and thickness of the dielectric layers can be designed to give an optical coating with specified reflectivity at different wavelengths of light.

As illustrated by FIG. 4, dielectric coatings can be designed to produce a very high reflectivity at a specific wavelength (narrowband) or they can be made to reflect a broad spectrum (broadband) of light. A further advantage of dielectric coatings is that the threshold at which dielectric coatings are damaged by laser light is approximately 10 times higher than for a metal coating.

The most straight forward way to utilise the dielectric coating with the method of GB2486628 would have been to use a broadband dielectric coating to reflect both the UV laser light and the visible light for imaging. However, as discussed, since the laser light not reflected from the mirror is thought to contribute to the degradation of the mirror surface, the present inventors decided that is more important that the reflectivity at the laser wavelength is as high as possible. This is more likely to be achieved consistently with a narrowband dielectric coating, optimised for the laser wavelength, rather than broadband dielectric coating, and thus a narrowband coating was chosen for the mirror so as to minimise coating degradation and maximise lifetime. A problem with this choice is that the reflectivity of visible light by the UV narrowband dielectric coating will be very low (<5%) and not adequate for imaging the electrode surfaces. Preferably, the reflectivity of the mirror at the laser wavelength is 99.9% or higher.

The first cleaning method resolves this problem by applying an aluminium coating to a second surface of the mirror to provide a second reflective surface that reflects the visible light that passes through the narrowband dielectric coating, to relay a high quality image of the electrodes to the camera. In an alternative implementation discussed below, the curvature of the second surface of the mirror is modified to provide a focussed image of the electrode(s) at the camera.

As in the embodiment shown in FIG. 2, in the embodiment shown in FIG. 4, the sample plate carrier is configured to be moved in a plane 421 substantially perpendicular to a beam axis of the laser. The sample plate 210 is moved into the beam axis of the laser such that light from the laser is focussed to converge at a first focal point 434.

Figure 5:
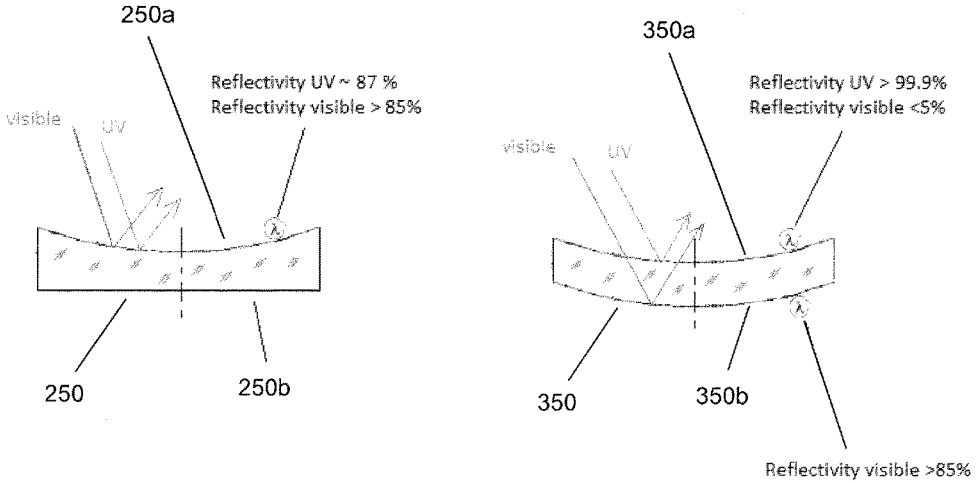
FIG. 5 shows a mirror 350 as used in a first cleaning method compared with the mirror 250 of FIG. 2.

FIG. 5 shows a mirror 350 as used in the first cleaning method compared with the mirror 250 of FIG. 2.

As shown In FIG. 5, the mirror 250 of FIG. 2 has a first (upper) surface 250*a* that is coated with a UV enhanced aluminium coating that has a UV reflectivity of ~87% and a visible light reflectivity of ~85%. The mirror 350 also has a second (lower) surface 250*b* that is ground (i.e. a rough non-optical surface).

As also shown in FIG. 5, the mirror 350 as used in the first cleaning method has a first (upper) surface 350*a* that is coated with a narrowband UV dielectric coating having a UV reflectivity of higher than 99.9%, but a visible light reflectivity of less than 5%. The mirror 350 also has a second (lower) surface that is coated with aluminium and has a visible light reflectivity of higher than 85%.

The first cleaning method comprised the following steps:

- at a first reflective surface 350*a* of the mirror 350, reflecting UV light that is produced by the laser for ionising sample material (that in this example has a wavelength of 355 nm) onto a surface of an electrode of the ion source so that contaminant material is desorbed from the surface of the electrode of the ion source;
- at a second reflective surface 350*b* of the mirror 350, reflecting visible light (that has a plurality of wavelengths in the range 390 nm to 700 nm) that comes from the surface of the electrode of the ion source towards an imaging apparatus for producing an image of the surface of the electrode of the ion source, wherein the visible light passes through the first reflective surface 350*a* of the mirror 350 before being reflected at the second reflective 350*b* surface of the mirror 350;

at the imaging apparatus (not shown), producing an image of the surface of the electrode of the ion source using the visible light (reflected at the second reflective surface 350*b*).

Note that the UV light produced by the laser for ionising sample material is reflected at the first reflective surface 350*a* of the mirror 350 at the same time as the visible light is reflected at the second reflective surface 350*b* of the mirror. In this way, an image of the surface of the electrode of the ion source can be produced (at the imaging apparatus) at the same time as contaminant material is desorbed from the surface of the ion source.

In the first cleaning method, the curvature of the second surface 350*b* of the mirror 350 was made equal to that of the first surface 350*b* since there was no particular advantage it making it otherwise since the ion source in which the mirror 350 was employed has the capability to automatically adjust the focus of both the laser and imaging optics systems, by translating optical components elsewhere in the optical paths, to compensate for given mirror curvature values.

Evaluation of this new cleaning method confirmed the mirror was still effective after 10 cleaning cycles and showed no sign of degradation (further testing required to determine actual lifetime). However, some build-up of material desorbed from electrodes by the first cleaning method could be seen deposited in region around mirror, which, whilst not immediately obvious, must also be on mirror and will at some point degrade the first cleaning method if not ultimately cleaned or replaced.

Figure 6:
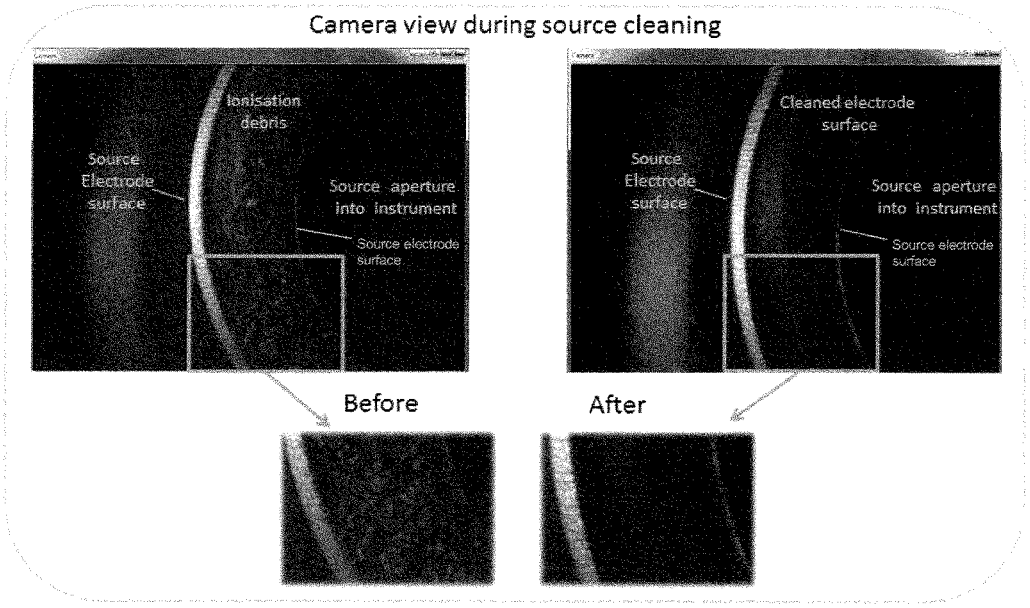
FIG. 6 shows images of the electrode before and after ion source cleaning using the first cleaning method.

FIG. 6 shows images of the electrode before and after ion source cleaning using the first cleaning method.

In FIG. 6, both the inner and outer surfaces of the annular electrode can be seen in the before and after pictures. These surfaces appear different since the visible light reflecting from the surfaces is different owing to the position of the visible light source (as noted above, this visible light source is typically located to provide illumination of the sample rather than of the electrodes). In other words, there is not uniform illumination of the electrode.

As an aside, both the before and after images of FIG. 6 include a blurred and slightly lightened annular region (located behind the text "Source Electrode surface"), which is a secondary, out of focus, image of the electrode formed by a small amount of visible light (<5%, see above) reflecting from the first surface 350*a* of the mirror 350 (this slightly lightened annular region can more clearly be seen from the after image compared with the before image).

As shown by FIG. 6, a good quality image of an electrode was achieved that clearly showed how debris on a contaminated electrode can be efficiently removed using this method.

2.2 Second Cleaning Method: a Two Surface Mirror Including a Dielectric Coated First Surface and an Aluminium Coated Second Surface (Surfaces Having Different Curvatures)

The second cleaning method is based on an insight of the present inventors that it may be desirable to make an ion source in which the laser for ionising a sample and the imaging apparatus for providing an image of the sample both have fixed focus.

Making such an ion source could be up to £1 k-£1.5 k cheaper than making an ion source in which the focus of the laser and optics are adjustable (2014 prices).

For normal operation, the laser and viewing optics of such an ion source would be focussed in the plane of the sample plate, so as to provide effective ionisation of the sample and in focus imaging of the sample. However, if such an ion source were cleaned using the first cleaning method, there would be a problem in that, when the UV and visible light are allowed to pass onto the cleaning mirror and reflect from the first and second surfaces respectively, the visible light has slightly further to travel than the UV light. Since in the first cleaning method the curvature of the first and second surfaces is the same, it is not possible for the both the first and second surfaces to provide identical focussing at the electrode surface, due to the finite thickness of the cleaning mirror This is not a problem when the instrument employing this iteration of the source cleaning method has the capability to automatically adjust the focus of the laser and/or viewing optics; however, the first cleaning method has more limited applicability for a system with fixed focus optics. This second cleaning method provides a solution to this problem by allowing the curvatures of the front and back surfaces of the mirror to be independently optimised to focus the laser and viewing optics in the required planes (for visual light the required plane is the plane of an image sensor, for UV light it is just off the plane of the electrode being cleaned) so as to match the geometry of the ion source in which the method is being employed. Of course this iteration of the method can still be equally well utilised in an instrument that does have variable optics.

Figure 7:
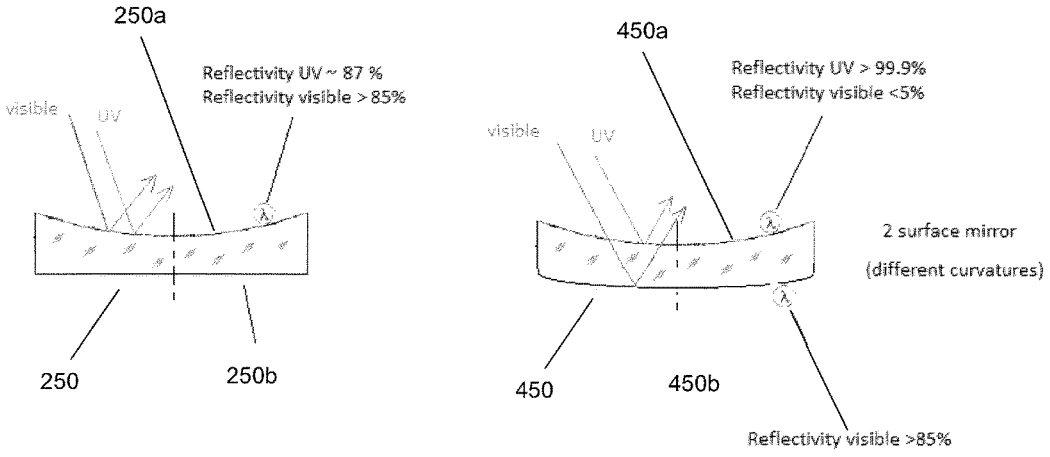
FIG. 7 shows a mirror 450 as used in a second cleaning method compared with the mirror 250 of FIG. 2.

FIG. 7 shows a mirror 450 as used in the second cleaning method compared with the mirror 250 of FIG. 2.

Here, the mirror coatings are the same as the first iteration, but the curvature of the surfaces 450*a* and 450*b* are independently chosen to match any ion source. In particular, the curvatures of first and second surfaces 450*a*, 450*b* of the mirror 450 can be optimised to focus laser and viewing optics respectively, e.g. onto a surface of an electrode.

Figure 8:
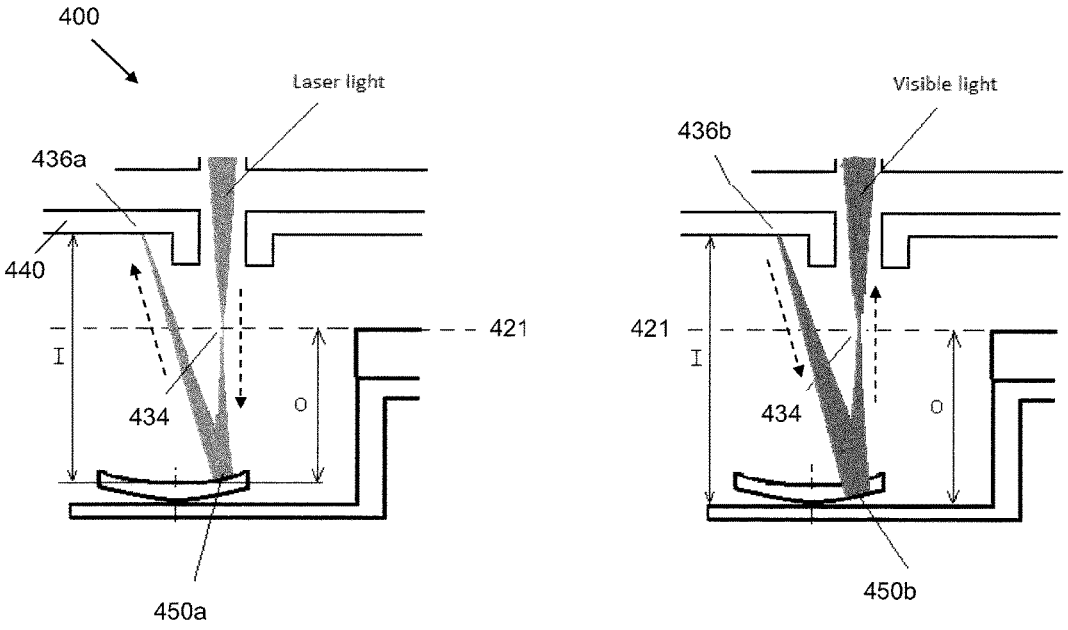
FIG. 8 shows an ion source using the second cleaning method, in which the custom concave mirror 450 is being used.

FIG. 8 shows an ion source using the second cleaning method, in which the custom concave mirror 450 is being used.

The second cleaning method comprised the following steps:

at a first reflective surface 450*a* of the mirror 450, reflecting UV light that is produced by the laser for ionising sample material (that in this example has a wavelength of 355 nm) onto a surface of an electrode 440 of the ion source so that contaminant material is desorbed from the surface of the electrode of the ion source;

at a second reflective surface 450*b* of the mirror 450, reflecting visible light (that has a plurality of wavelengths in the range 390 nm to 700 nm) that comes from the surface of the electrode 440 of the ion source towards an imaging apparatus for producing an image of the surface of the electrode of the ion source, wherein the visible light passes through the first reflective surface 450*a* of the mirror 450 before being reflected at the second reflective 450*b* surface of the mirror 450;

at the imaging apparatus (not shown), producing an image of the surface of the electrode of the ion source using the visible light (reflected at the second reflective surface 450*b*).

In the left hand drawing of FIG. 8, UV laser light is shown as being focused to a refocused laser spot 436*a* on a surface of the first electrode 440 by the first mirror surface 450*a*. The direction of travel of the laser light is shown by a dashed arrow.

In the right hand drawing of FIG. 8, visible light from a region 436*b* of the surface of the first electrode 440 (that is to be imaged by the imaging apparatus) is shown as passing through the first surface 450*a* of the mirror 450 whilst being reflected at the second surface 450*b* of the mirror 450. The direction of travel of the visible light is shown by a dashed arrow. Note that the direction of travel of the visible light is opposite to that of the laser light.

The first reflective surface 450*a* is coated with a narrowband dielectric coating optimised for the laser wavelength and the surface curvature calculated to refocus the laser beam on the electrode surface. The visible light passes through this coating and is reflected by the aluminium coating on the second reflective surface 450*b*, the curvature of which is calculated to form a focussed image of the electrode in the imaging apparatus (in this example a camera).

Thus, a narrowband dielectric coated first reflective surface 450*a* coating reflects UV light from the laser and transmits visible light, whilst an aluminium coated second reflective surface 450*b* reflects the visible light.

A preferred radius of curvature (R) of each mirror surface 450*a*, 450*b* may be given by R=2IO/(I+O) with reference to FIG. 8. It should be noted that the optimum cleaning configuration is likely to be slightly away from the best laser focus to give the best balance between cleaning efficiency (which is closely related to energy density) and area cleaned per laser pulse.

A range of surface curvatures are possible; values used in the methods described here are in the range 30 mm to 50 mm, but larger values are possible, e.g. up to 200 mm could easily be envisaged, but the larger curvature values require the housing containing the source cleaning mechanism to be larger and values much larger than this are not likely to be practical.

The diameter of the mirrors 350, 450 used here were 25 mm, but only about 10 mm of the mirrors were actually used; again larger diameter mirrors could be used, but there appears to be no practical advantage; so the method preferably uses mirrors of diameter in the range 5 mm to 50 mm.

As discussed above, the beam axis of the laser and the optical axis of the camera should be close together but offset from each other, e.g. by a small angle (preferably 10° or less, more preferably 5° or less), so as to allow the light produced by the laser to be separated from the light received by the imaging apparatus, e.g. using one or more optical/beam steering components (e.g. mirrors).

It should be noted that preferably neither the beam axis nor the optical axis should be exactly coincident with the central axis of the electrodes, since this is the preferred travel path for ions produced by the sample when the ion source is in use (see e.g. FIG. 1(*b*), described above).

The mirror 450 described in the second cleaning method could be utilised in a number of configurations depending on the complexity of the instrument within which the ion source is installed:

(i) In a simple instrument, with a fixed focus laser and/or camera (e.g. no capability to automatically adjust the laser focus and/or camera focus), the mirror curvatures are preferably specified to focus laser and camera on single specified electrode surface, probably the surface most likely to suffer from build-up of contamination, which may be the first electrode surface 440.

(ii) Again, in a simple instrument, with a fixed focus laser and/or camera (e.g. no capability to automatically adjust the laser and/or camera), but with electrode surfaces close together (e.g. less than or equal to 5 mm), the mirror could be specified with a laser focus mid-way between the two electrode surfaces such that they receive an equal power density appropriate for the source cleaning method.

(iii) Again, in a simple instrument with a fixed focus laser and/or camera (e.g. no capability to automatically adjust the laser and/or camera), but with electrode surfaces that are not close together (e.g. more than 5 mm), the ion source could include multiple mirrors, with each mirror having first and second reflective surfaces, wherein the curvature of the first and/or second reflective surfaces differ between mirrors, so that each mirror is configured to provide appropriate focussing for a respective surface (or combination of surfaces) of the ion source. The multiple mirrors would preferably be mounted in the same plane.

(iv) Again, in a simple instrument with a fixed focus laser and/or camera (e.g. no capability to automatically adjust the laser and/or camera), but with electrode surfaces that are not close together (e.g. more than 5 mm), the ion source could include multiple mirrors having identical curvatures whilst being mounted at different heights appropriate for the surfaces to be cleaned.

(v) In an instrument with an adjustable focus laser and/or an adjustable focus camera (either by translating optics along axis as preferred by the inventors, or by inserting/removing elements from the optical system with an appropriate mechanism), the mirror curvatures could be specified to clean at least one surface with the laser/camera focus adjustment mechanism being adjusted to refocus the laser/camera on further electrodes. This is only a marginal benefit as the main benefit of the second cleaning method is when the laser and camera are fixed focus.

Whilst the methods described above preferably use first and second reflective surfaces that have spherical curvature (which, in practice has been found to be adequate for the purposes of cleaning and providing an image), other reflector shapes could be used instead. For example, parabolic reflective surfaces would be possible, but the cost of manufacture is likely to be significantly more than simple spherical form.

Although not preferred, a possible focus adjustment mechanism that could provide focussing of both laser light and visible light in an ion source that would otherwise have no capability to adjust the laser and/or camera focus, would be to have an optical lens movable into the path of visible light travelling from the electrode surface to the imaging apparatus, so as to provide an optical correction for the extra distance travelled by visible light compared with the UV light when reflecting from the mirror. Such a modification would, for example, allow the mirror 350 to be used in an ion source with no capability to automatically adjust the laser and/or camera.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

All references referred to above are hereby incorporated by reference.

The invention claimed is:

1. A method of cleaning an ion source, the method including:

at a first reflective surface of a mirror, reflecting ultraviolet light that has a wavelength in a first wavelength band onto a surface of the ion source so that contaminant material is desorbed from the surface of the ion source, wherein the ultraviolet light has a wavelength in the range 10 nm to 400 nm and is produced by a laser;

at a second reflective surface of the mirror, reflecting visible light that has a plurality of wavelengths in a second wavelength band and that comes from the surface of the ion source towards an imaging apparatus for producing an image of the surface of the ion source using the visible light, wherein the visible light has a plurality of wavelengths in the range 390 nm to 700 nm and is produced by a light source, separate from the laser, for illuminating the surface of the ion source with visible light, wherein the visible light passes through the first reflective surface of the mirror before being reflected at the second reflective surface of the mirror.

2. A method according to claim 1, wherein the ion source includes a laser for ionising sample material by firing light at the sample material and the ultraviolet light that has a wavelength in the first wavelength band is produced by the laser for ionising sample material.

3. A method according to claim 1, wherein the first reflective surface of the mirror has a reflectivity of 99% or more to the ultraviolet light that has a wavelength in the first wavelength band.

4. A method according to claim 1, wherein the ion source includes an imaging apparatus for producing an image of the sample, wherein the imaging apparatus for producing an image of the sample is also used as the imaging apparatus for producing an image of the surface of the ion source.

5. A method according to claim 1, wherein the surface of the ion source is a surface of an electrode of the ion source.

6. A method according to claim 1, wherein the method includes, at the imaging apparatus, producing an image of the surface of the ion source using the visible light that has a plurality of wavelengths in the second wavelength band.

7. A method according to claim 1, wherein the ultraviolet light that has a wavelength in the first wavelength band is reflected at the first reflective surface of the mirror at the same time as the visible light that has a plurality of wavelengths in the second wavelength band is reflected at the second reflective surface of the mirror.

8. A method according to claim 1, wherein the method includes moving the mirror to scan the ultraviolet light that has a wavelength in the first wavelength band across the surface of the ion source.

9. A method according to claim 1, wherein the first and second reflective surfaces of the mirror are concave with respect to a laser for ionising sample material.

10. A method according to claim 1, wherein the first and second reflective surfaces have the same curvature.

11. A method according to claim 1, wherein the first and second reflective surfaces have different curvatures.

12. A method according to claim 1, wherein the mirror is mounted on a sample holder for holding sample material to be ionised by the ion source, and wherein the mirror is mounted on the sample holder such that the first and second reflective surfaces are at a different distance from a laser for ionising sample material compared with a sample held by the sample holder.

13. An ion source for producing ionised sample material, the ion source including a mirror including a first reflective surface and a second reflective surface, wherein the ion source is configured to be cleaned by a method that includes:

at the first reflective surface of the mirror, reflecting ultraviolet light that has a wavelength in a first wavelength band onto a surface of the ion source so that contaminant material is desorbed from the surface of the ion source, wherein the ultraviolet light has a wavelength in the range 10 nm to 400 nm and is produced by a laser;

at the second reflective surface of the mirror, reflecting visible light that has a plurality of wavelengths in a second wavelength band and that comes from the surface of the ion source towards an imaging apparatus for producing an image of the surface of the ion source using the visible light, wherein the visible light has a plurality of wavelengths in the range 390 nm to 700 nm and is produced by a light source, separate from the laser, for illuminating the surface of the ion source with visible light, wherein the visible light passes through the first reflective surface of the mirror before being reflected at the second reflective surface of the mirror.

* * * * *